US006643966B2

(12) United States Patent
Schmitt

(10) Patent No.: US 6,643,966 B2
(45) Date of Patent: Nov. 11, 2003

(54) BANNER SIGN DISPLAY STAND

(76) Inventor: Anthony J. Schmitt, 254 Dennison Dr., Ballwin, MO (US) 63021

( * ) Notice: Subject to any disclaimer, the term of this patent is extended or adjusted under 35 U.S.C. 154(b) by 0 days.

(21) Appl. No.: 10/092,402

(22) Filed: Mar. 5, 2002

(65) Prior Publication Data

US 2002/0121034 A1 Sep. 5, 2002

Related U.S. Application Data

(60) Provisional application No. 60/273,393, filed on Mar. 5, 2001.

(51) Int. Cl.[7] ..... G09F 15/00
(52) U.S. Cl. ..... 40/610; 40/604
(58) Field of Search ..... 40/603, 604, 610, 40/606; 248/127, 158, 159, 165

(56) References Cited

U.S. PATENT DOCUMENTS

| | | | | | |
|---|---|---|---|---|---|
| 1,974,076 | A | * | 9/1934 | Lindenberger | 40/603 |
| 4,368,586 | A | | 1/1983 | Forzelias | |
| 4,700,498 | A | * | 10/1987 | Perutz et al. | 40/603 |
| 4,959,916 | A | * | 10/1990 | Cochrane | 40/603 |
| 5,040,321 | A | * | 8/1991 | Stoudt | 40/611 |
| 5,095,642 | A | * | 3/1992 | George et al. | 40/606 |
| 5,839,705 | A | | 11/1998 | LaMotte | |
| 5,983,545 | A | * | 11/1999 | Marco | 40/610 |
| 6,038,802 | A | * | 3/2000 | Tidwell | 40/610 |
| 6,115,951 | A | * | 9/2000 | Jing et al. | 40/610 |
| 6,161,320 | A | * | 12/2000 | Peterson | 40/605 |
| 6,332,284 | B1 | * | 12/2001 | Tafforeau | 40/603 |
| 6,370,803 | B1 | * | 4/2002 | Burquest | 40/606 |
| 6,412,743 | B1 | * | 7/2002 | Fell | 248/441.1 |
| 6,457,684 | B1 | * | 10/2002 | McKendry | 248/127 |

OTHER PUBLICATIONS

Visual X'PO—"Free–standing Image Display"—distributed by "Southtrend" 4 pages from web site.

"Who Is TigerMark?"—TigerMark Coporate Headquarters–Eric Miller, President—7 pages from web site.

"Simplicity The Frameless Contour System" from Affordable Exhibit Displays, Inc 2 pages from web site.

"Xtra Lite—Display Systems" from Xtra Lite Display Systems, Inc. 9 pages from web site.

* cited by examiner

*Primary Examiner*—Gary Hoge
(74) *Attorney, Agent, or Firm*—Polster, Lieder, Woodruff & Lucchesi L.C.

(57) ABSTRACT

A banner stand for displaying banners or signs is disclosed. The banner stand is lightweight, portable, and easy to assembly while utilizing a minimum of parts. The banner stand includes a base tube with a flat, external portion against which two flat feet are secured. The feet may be rotated to extend laterally when the banner stand is erected and longitudinally when the banner stand is collapsed and stored. The base tube is substantially hollow providing a storage compartment for a pole assembly, the storage compartment being closed by end caps. The pole assembly is a multi-pole assembly that may collapse to the length of the longest pole, and each piece is connected by an elastic cord which also serves to hold the assembly together when the banner stand is erected. Between two of the poles of the pole assembly is a spring. In order to erect the stand, this spring is temporarily compressed and, upon returning to its original size, places the sign or banner under tension. When the stand is erected, the bottom end of the pole assembly fits within a bore in the top of the base tube, and the top end of the pole assembly attaches to a hanger. The hanger is attached to the top edge of the banner, while the bottom edge of the banner is attached to the base tube. When the banner and banner stand are collapsed for storage, the banner may be rolled around the base tube and feet and then be secured by a Velcro strip attached to the hanger. This permits a smooth, compact unit when in storage that may easily be placed within a carrying case or pouch.

24 Claims, 4 Drawing Sheets

BANNER SIGN DISPLAY STAND

CROSS-REFERENCE TO RELATED APPLICATIONS

This application claims the benefit of Provisional Application 60/273,393, filed Mar. 5, 2001, which is incorporated herein by reference.

STATEMENT REGARDING FEDERALLY SPONSORED RESEARCH OR DEVELOPMENT

Not Applicable.

BACKGROUND OF THE INVENTION

This invention relates to displaying of signs, specifically to a banner stand for displaying signs or banners as parts of presentations and or at trade shows and the like. Presently, there are many designs and constructions for banner stands.

In communicating information about a product or an idea, it is well-known that the use of visual aids benefits the understanding and can assist in increasing the attractiveness of the product or idea. A visual aid simplifies and expedites the viewer's intake of information. The ability to reach a passive viewer and make that viewer actively consider the idea or the product promotes the communicating of information about the product or idea.

There are many arenas in which people or organizations seek to attract attention to make viewers' interest more active and to simplify a viewer's intake of information, such as in a business presentation or at a trade show. Various visual aids may include overhead projectors, slide shows, hand-held or easel-held signs, pamphlets or brochures, and free-standing signs or banners.

This invention is directed at free-standing signs or banners. Typically, it is desired to be able to simply and quickly erect a catchy sign or banner, which will then prominently display information in an eye-catching manner. These banners are erected for temporary use only, such as a business presentation, which may continue for minutes or hours or a trade show which may last for several days. These arenas are not ones in which it is necessarily desired that the sign be permanently erected. Consequently, the banner stand should be light-weight and easily transported, and it should be compact when transported.

In order to be compact, it is ideal to allow the banner stand to be erected when in use and collapsed when transported. Accordingly, the banner stand should be sturdy enough to be erected and collapsed multiple times. However, the durability need not be limitless; most banners and banner stands are needed for a finite number of presentations over a short period of time, or a finite number of tradeshows for a particular season. In addition, as the banners are manually erected and collapsed a number of times and displayed in various environments, there is a finite life to the sign or banner itself. That is, at some point the wear and tear on the sign makes it less desirable for display.

Additionally, ease of transport is facilitated by providing a case or pouch or other carrying device which easily accepts the banner stand and is easily carried. It is also convenient if the exterior of the case allows for easy identification, either of the owner, of the contents, or of both.

The banners or signs are physically flexible. Typically, these signs are made of a natural fiber cloth, of a cloth made of woven synthetic fibers, or of a sheet or sheets of flexible plastic. Flexible signs are preferred because of ease of transport and collapse. When the signs or banners are collapsed for transport, there is a desire to protect the indicia displayed on them. For this reason, a carrying case or pouch is preferred in conjunction with the sign, not only for the sign but also for whatever means is used for displaying the sign, such as a banner stand.

The banner stand should be simple to erect and collapse. Many of the people who use such stands are not necessarily mechanically inclined. In addition, many of the people who use them are focused on conveying information and selling a product or idea. In other words, many of the people who use them do not desire to spend an inordinate amount of time or intellect in erecting or collapsing a banner stand and its banner or sign.

In order to make the banner stand simple to erect and collapse, it should have a minimum number of parts. It is also desired that directions or steps in order to assemble the banner stand are obvious and simple, not requiring dexterity or undue concentration.

In affixing a banner or sign to a banner stand, one must ensure that the vertical and horizontal lines are correct in relation to the banner stand. Otherwise, the banner will hang askew. Additionally, one must ensure each fixed edge of the banner (typically the top and the bottom edges of the banner) are smoothly affixed, without any bunching or stretching.

Affixing a banner or sign to a banner stand can be simple and with a low cost. In some systems, the banner can be removed and replaced; however, this is a much more complicated process and requires a more complex banner stand and more labor than banner stands which simply allow for permanent gluing or the like. Once a banner or sign has seen its perceived useful life, it is often discarded.

Accordingly, it is desirable for a banner stand to be discardable or disposable along with the banner or sign. This requires a low cost banner stand.

BRIEF SUMMARY OF THE INVENTION

In accordance with on aspect of the present invention, generally stated, a banner stand for displaying a banner including a generally tubular base, a banner wrapped around the base, and a pole assembly contained inside the base is disclosed. The banner is attached to an external surface of the base. The pole assembly includes a spring which is compressed in order to attach the banner to the pole assembly placing the banner under tension. The banner stand includes a hanger attached to the banner. Preferably, the banner stand includes a carrying case in which the banner stand is removably contained.

In accordance with another aspect of the present invention, a banner stand for displaying a banner including a banner attached to a base tube and a hanger, and a collapsible pole assembly including a spring, the spring being located within the center of the pole assembly and compressed in order to attach the banner to the pole assembly so the banner is under tension. The base tube is generally hollow allowing the pole assembly to be stored within the base tube. The banner, when stored, is wrapped around an external surface of the base tube. The pole assembly further includes an elastic cord, the pole assembly being generally hollow, and preferably having a square cross-section. The pole assembly comprises a first pole, a second pole, and a third pole. The banner stand also includes a carrying case, the banner stand being removably contained in the carrying case.

In accordance with another aspect of the present invention, a banner stand for displaying a banner including a banner, a pole assembly, a hanger attached to the banner and to the pole assembly, and a base including a generally horizontal hollow base tube, the base tube including a socket for mounting the pole assembly in a vertical position. The base includes at least one elongate flat foot, wherein the base tube includes a lower external flat surface, wherein the foot each has a point of mounting against the external flat surface of the base tube and may be rotated around respective points of mounting to be orthogonal to the central axis of the base tube when the banner stand is erected and to be parallel to central axis of the base tube when the banner stand is collapsed and stored. The socket includes a spacer and a pole bore, the pole assembly fitting into the pole bore and the spacer fitting within the pole assembly so as to secure the pole assembly in a vertical position. The spacer is mounted by a pole rivet located on an inside surface of the base tube, and the spacer is located diametrically opposite the pole bore. The pole assembly may be collapsed such that the pole assembly may be inserted into one end of and completely enclosed within the base tube during storage. The base tube includes end caps for securing the pole assembly within the base tube during storage.

In accordance with another aspect of the present invention, a method of collapsing a banner stand with an attached banner, the method including compressing a spring located within a pole assembly to release tension on a sign or banner, disconnecting the pole assembly from a hanger to which the banner is attached, collapsing the pole assembly, storing the pole assembly on or in a base tube to which the banner is attached, rotating at least one foot attached to the base tube so that the foot is substantially parallel to the central axis of the base tube, and rolling the banner around the base tube. The method preferably includes disconnecting multiple poles which remain connected by an elastic cord, removing the bottom end of the pole assembly from the base tube, and aligning the multiple poles against each other so they may be stored side-by-side within the base tube. The method preferably includes securing the pole assembly within the base tube by closing the ends of the base tube with end caps, securing the end caps with closures.

Preferably, the closures are Velcro strips and their mates. The preferred method includes securing the banner after it has been rolled around the base tube with a closure.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
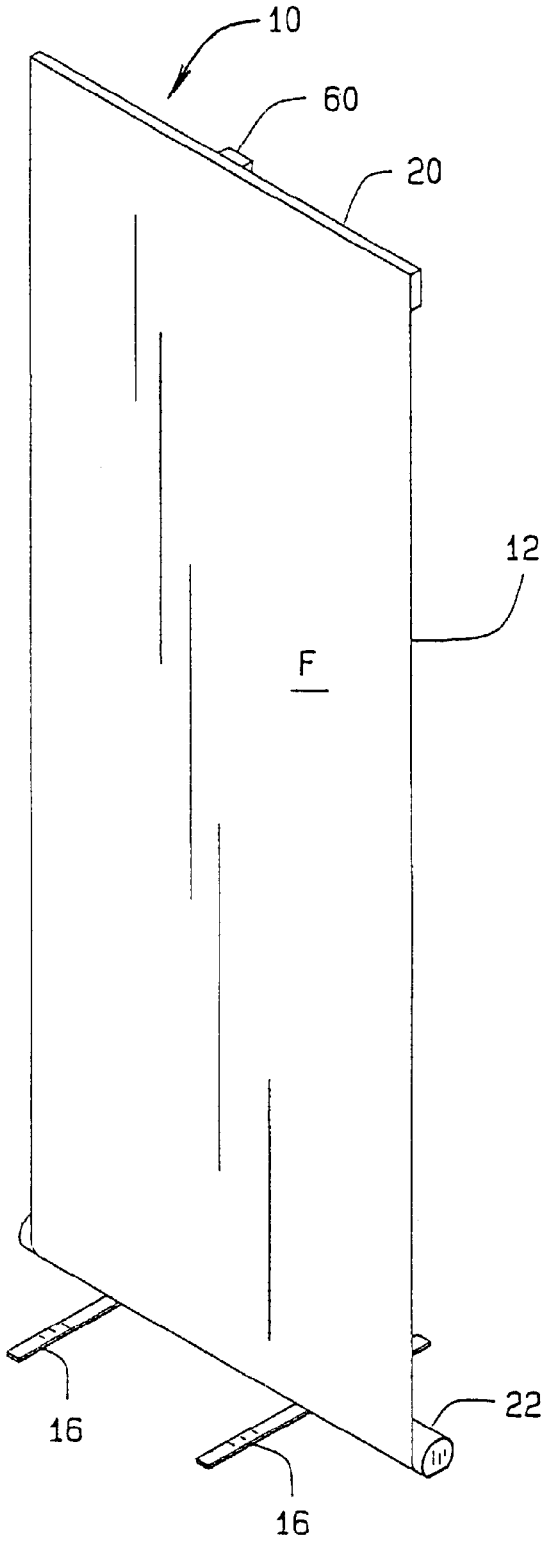
FIG. 1 is a perspective view of the banner stand of the present invention in an erect position with a banner attached.

Referring initially to FIG. 1, a banner stand 10 is depicted in an erect position with an attached banner 12 that typically has a graphic, sign or other indicia adorning the banner's front face F. The banner stand 10 includes two feet 16 for maintaining the banner stand in an erect position, a pole assembly 18 for supporting the banner 12, a hanger 20 attached to the back face B (see FIG. 4) of the banner 12 and removably attached to the pole assembly 18, and a base tube 22 to which the banner 12 and the feet 16 attach. The hanger 20 is made of hollow aluminum tubing with a rectangular cross-section with a depth of ¼", height of 1", and a width approximate that of the width of the banner 12. The hanger 20 has two end caps 19 (see FIG. 3) made of a polymeric material in order to provide a smooth surface to the ends of the hanger 20.

The base tube 22 and the feet 16 comprise a base 23 for supporting the banner stand 10 and banner 12. In the preferred embodiment, the base tube 22 is a tubular extrusion of a suitable thermoplastic material. This construction provides simplicity and ease of manufacturing from standard, commonly available components. However, it is appreciated that a cross-sectional structure other than a circle may be used for the base tube 22, such as a square or quadrilateral.

Figure 2:
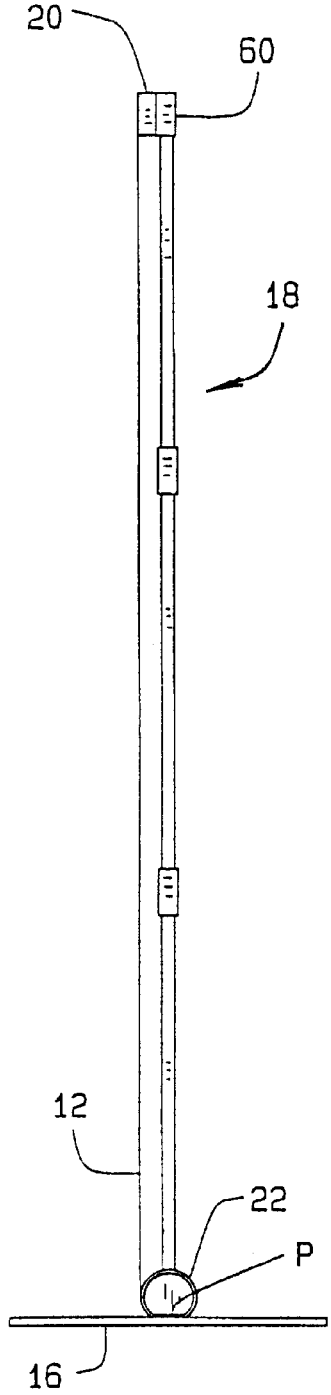
FIG. 2 is a side elevation view of the banner stand of the present invention in an erect position with a banner attached.

Referring now to FIG. 2, the banner stand 10 and banner 12 are depicted from one side. As can be seen, the feet 16 abut and are connected to the base tube 22 so as to be oriented orthogonally to the base tube 22 and the pole assembly 18.

Figure 3:
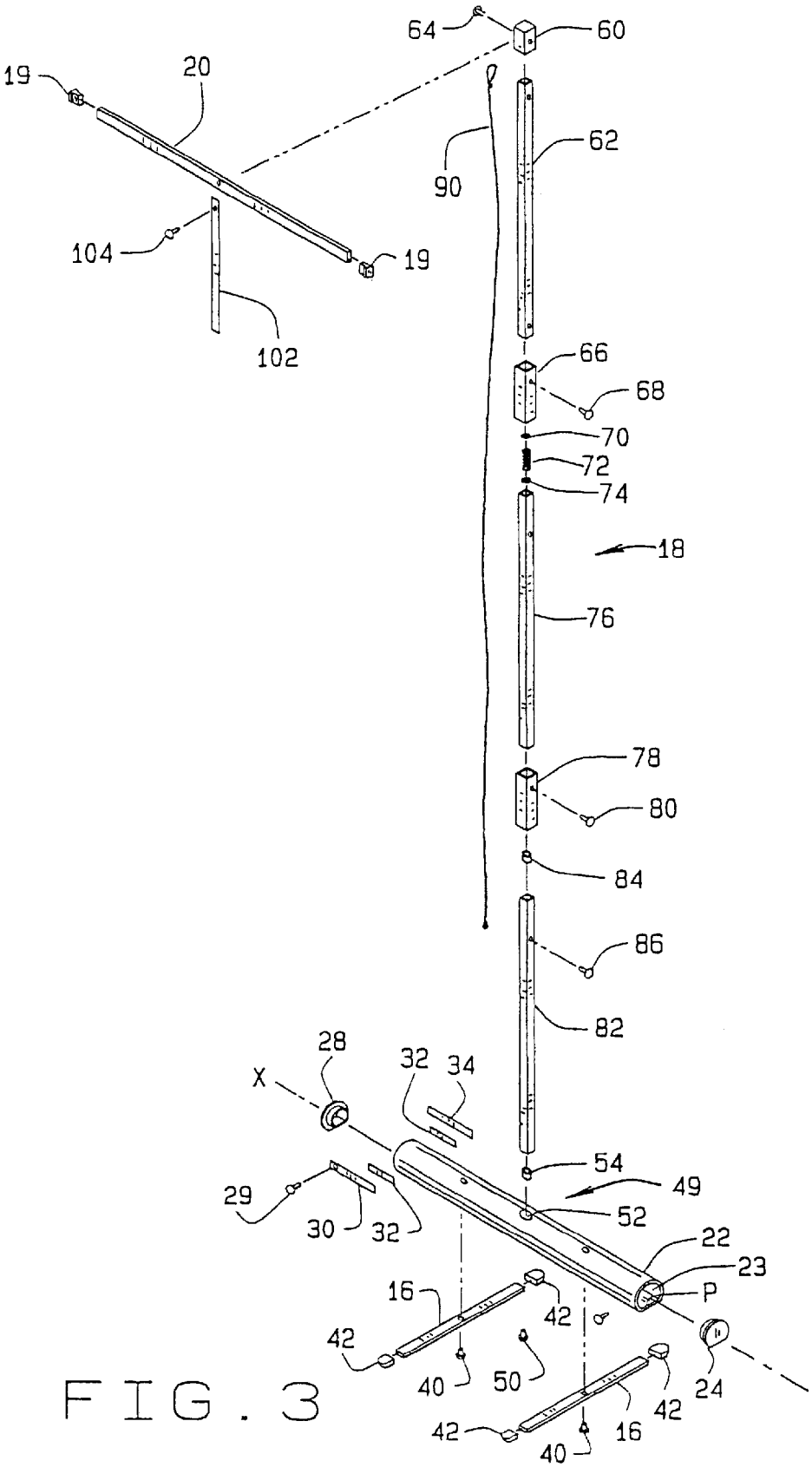
FIG. 3 is an exploded view of the banner stand of the present invention.

Referring now to FIG. 3, the various parts of the banner stand 10 are depicted. The base tube 22 is generally cylindrical and hollow. The outer surface of the base tube 22 includes a flat portion P along the longitude of the base tube 22 which forms a plane parallel to the central axis X of the base tube 22. The base tube 22 is hollow, forming a storage compartment 23 for the pole assembly 18. Other structures that may be substituted for the preferred base tube 22 are preferably hollow to provide storage compartment 23, although other methods of providing storage, such as depressions in the base tube 22, may be provided. The opening at one end of the base tube 22 is closed by a first base cap 24 secured by a rivet 26 or the like. The opening at the other end of the base tube 22 may be opened or closed by a second base cap 28. The second base cap 28 has a first Velcro strip 30 which is permanently affixed both to the second base cap 28 by a rivet 29, or the like, and to the base tube 22 by adhesive 32. A second Velcro strip 34 is permanently affixed only to the base tube 22 by adhesive 32.

The first Velcro strip 30 extends substantially across the outer face of the second base cap 28. When the second base cap 28 is inserted in the opening in the base tube 22, the second Velcro strip 34 may be mated with the first Velcro strip 30, thereby securing the second base cap 28 in the opening in the base tube 22.

Each of the feet 16 is attached to the flat portion P of the base tube 22 with a rivet 40 allowing the foot 16 to rotate around its center point relative to the base tube 22. Each foot 16 is generally a flat bar, the ends of which are capped by plastic end pieces 42. When the banner stand 10 is in the erect position, the feet 16 are turned to be orthogonal to the tube 22. When the banner stand 10 is in the closed position, the feet 16 are rotated so the length of each foot is against the flat portion P of the base tube 22, generally parallel to the tube 22 (see FIG. 4).

At the geometric center of the flat portion P of the base tube 22 is a socket 49. In the preferred embodiment, the socket 49 is composed of a pole rivet 50, a pole bore 52, and a first spacer 54. The pole rivet 50 is attached to the flat lower portion P of the base tube 22. The pole bore 52 extends through the side of the base tube 22 diametrically opposite the pole rivet 50. The first spacer 54 is inserted through the pole bore 52 and subsequently affixed to the base tube 22 by the pole rivet 50. When the banner stand 10 is in the erect position, the pole assembly 18 fits into the pole bore 52 and around the pole rivet 50 and first spacer 54, thus being generally vertical.

When the banner stand 10 is in the collapsed or closed position, the base tube 22 is used as a storage compartment 23 for the pole assembly 18. In the preferred embodiment, the pole assembly 18 is generally hollow with a square cross-section. The pole assembly 18 is described herein beginning with its uppermost portion when the banner stand 10 is in the erect position. A pole cap 60 fits over the uppermost portion of a first pole 62. The pole cap 60 is secured to the first pole 62 by a hanger pin 64 which protrudes a distance of ¼–½ inch from a sidewall of the pole cap 62 and extends through the sidewall of both the pole cap 62 and the first pole 62. Preferably, the hanger pin 64 extends to or through the inside surface of the opposite sidewall of the first pole 62 so as to secure an elastic cord, 90, discussed below.

Fitting over the bottom-most portion of the first pole 62 is a first connector 66 secured by a set screw 68. The first connector 66 being larger than the first pole 62, the end of the first pole 62 forms a ledge within the first connector 66. Against this ledge and within the first connector 66, a first washer 70 and a spring 72 and a second washer 74 are placed in respective series.

When the banner stand 10 is in the erect position, the uppermost portion of a second pole 76 removably fits into the first connector 66. The second pole 76 is generally the same size and cross-sectional shape as the first pole 62. Accordingly, the end of the sidewalls of the second pole 76 abuts the second washer 74.

Fitted over the bottom-most portion of the second pole 76 is a second connector 78, secured by a set screw 80. Within the second connector 78, a third pole 82 is removably fitted. As the third pole 82 has generally the same size and cross-section as the first and second poles 62 and 76, the end of the sidewalls of the third pole 82 abuts the end of the sidewalls of the second pole 76. Within the upper end of the third pole 82, a second spacer 84 is located and affixed by a rivet or set screw 86 through a sidewall of the third pole 82.

Connected to the pole cap 60 by the hanger pin 64 is the elastic cord 90, as previously mentioned. The elastic cord 90 extends respectively through the first pole 62, first connector 66, first washer 70, spring 72, second washer 74, second pole 76, and second connector 78. The elastic cord 90 terminates at and is secured by the second spacer 84 within the third pole 82.

When the banner stand 10 is in the erect position, the elastic cord 90 places in tension and holds together the various parts of the pole assembly 18. However, by its nature, the elastic cord 90 may be stretched so the various parts may be unfitted at the first and second connectors 66, 78. Thus, the pole assembly 18 may be collapsed and stored within the base tube 22, as is shown in FIG. 4.

Figure 4:
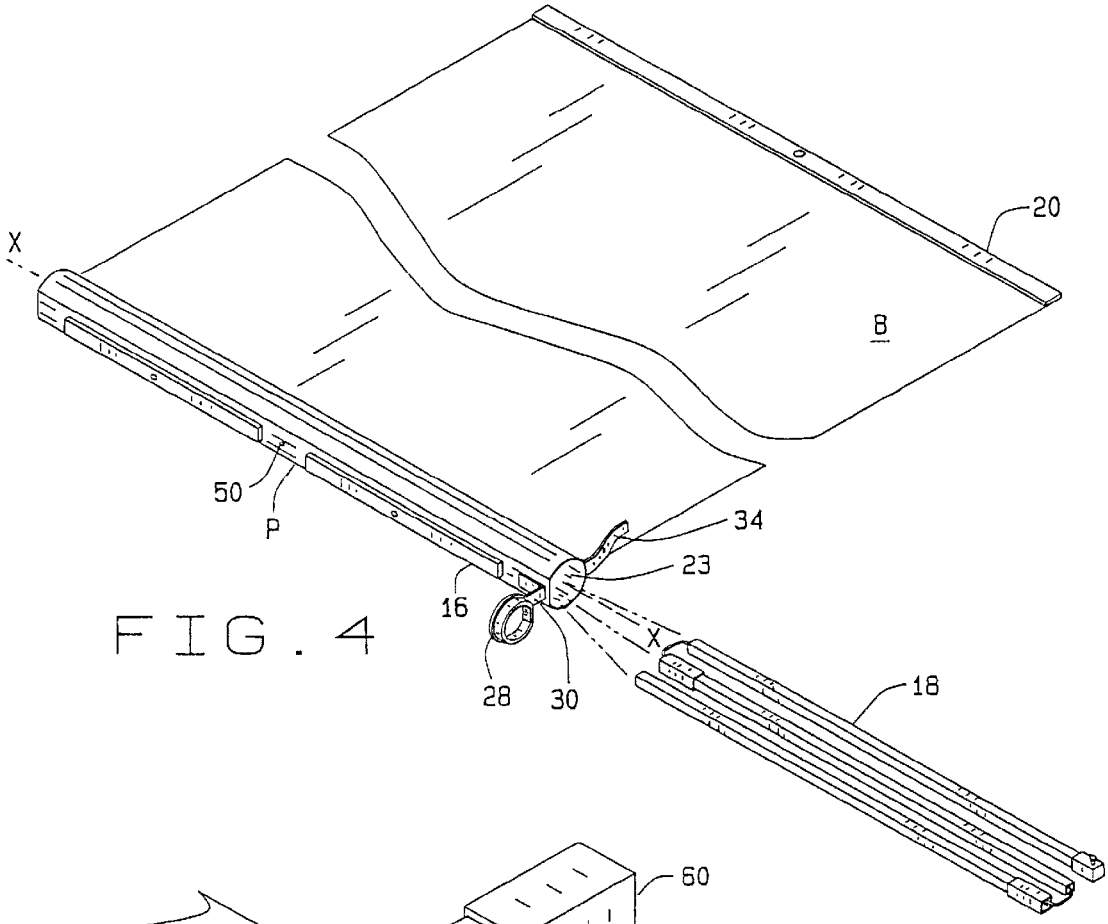
FIG. 4 is a perspective view of the parts of the banner stand of the present invention prior to assembly.

Referring now to FIG. 4, the hanger 20 is shown along the back face B of the banner 12. Preferably, the hanger is permanently affixed with glue to the back face B along the top edge of the banner 12. The bottom edge of the back face B of the banner 12 is preferably permanently secured with to the base tube 22 along an edge of the base tube 22 generally directed towards an observer of the banner 12. To minimize viewer distraction, it is preferred that the banner 12 is affixed to the base tube 22 proximate and adjacent the flat portion P of the base tube 22. As can be seen in FIG. 4, the pole assembly 18 may be removed from the socket 49 and collapsed. The base tube 22 provides a convenient storage compartment 23 for the pole assembly 18. The feet 16 are shown rotated as to generally be parallel to the central axis X of the base tube 22.

Figure 5:
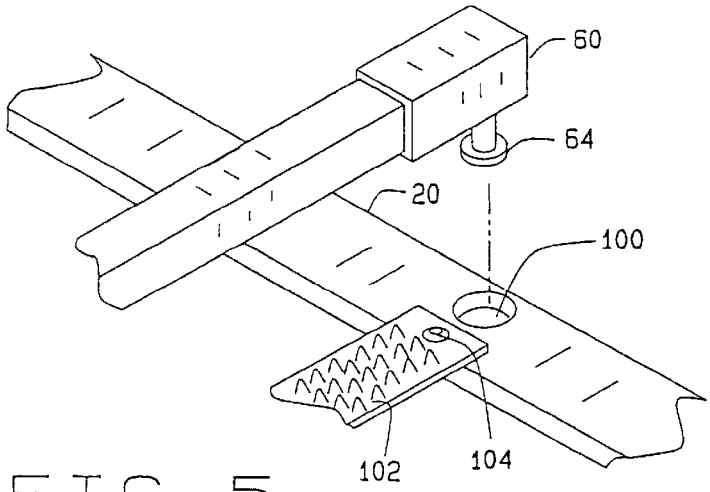
FIG. 5 is a perspective view of a portion of the banner stand of the present invention.

Referring now to FIG. 5, the hanger 20 and pole cap 60 are shown in detail. The hanger 20 includes a pin bore 100 into which the hanger pin 64 is inserted when the banner stand 10 is in an erect position. The pin bore 100 is a hole in one wall of the hanger 20 and is located centrally in the hanger 20. Also attached to the hanger 20 is a Velcro strip 102 which, when the banner stand 10 is in a closed or collapsed position for storage, wraps around the banner 12 and banner stand, as is shown in FIG. 6.

Figure 7:
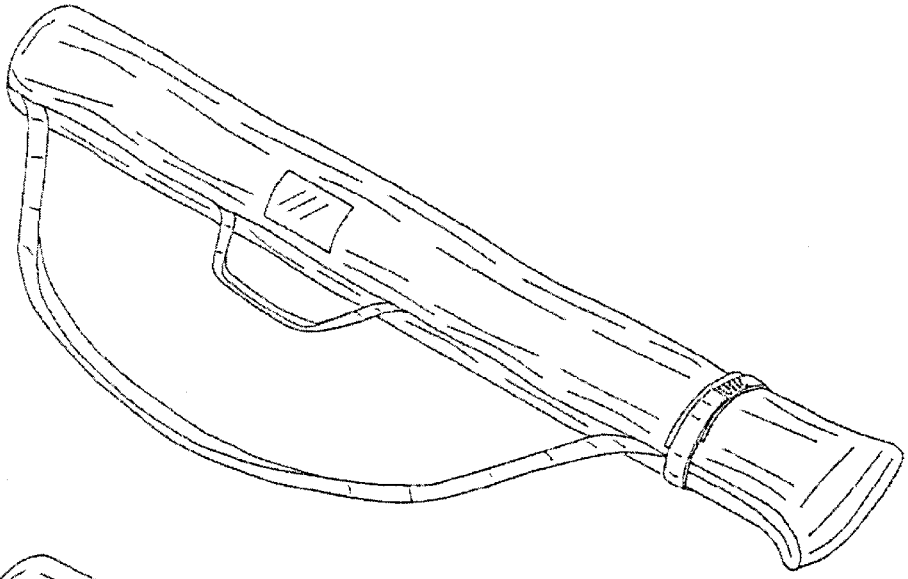
FIG. 7 is a perspective of the carrying case of the banner stand of the present invention in a closed position.
Figure 6:
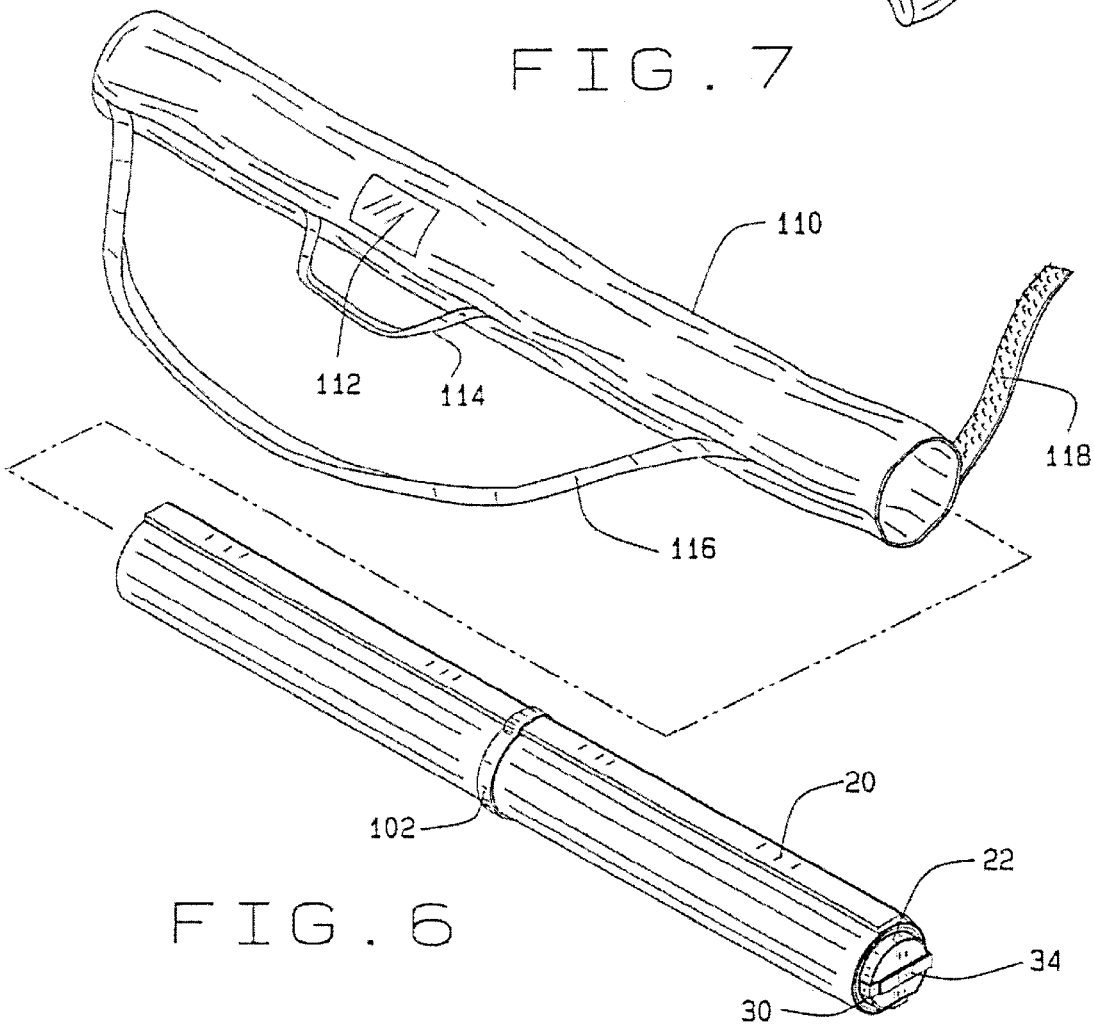
FIG. 6 is a perspective view of a carrying case for the banner stand of the present invention in an open position, and of the banner stand of the present invention in a storage position.

Once the pole assembly 18 is collapsed and inserted within the base tube 22, as shown in FIG. 4, the banner 12 is wrapped around the base tube 22, as can be seen in FIG. 6. For this reason, it is preferred that the base tube 22 be generally a round cylinder. As the banner 12 is wrapped around the base tube 22, the generally smooth round shape minimizes abrasive damage from handling of the collapsed banner 12 and prevents creasing the banner 12 when it is wrapped around the base tube 22. The Velcro strip 102 attached to the hanger 20 adheres to itself to hold the banner 12 tightly. The second end cap 28 is secured with the Velcro strip 30 and Velcro strip 34. The banner stand 10 and banner 12 may then be inserted within a carrying case 110. The carrying case 110 includes an identification window 112, a handle 114, and a shoulder strap 116. The carrying case preferably closes with a Velcro strip 118. In FIG. 7, the carrying case 110 is depicted with its closure secured. Preferably, the carrying case 110 is made of canvas or a nylon weave that is lightweight, durable, soft, and attractive.

It should be noted that many of the parts of the banner stand 10 of the present invention have equivalents. For instance, the base tube 22, as discussed above, may have a different shape and structure from a tube. In addition, the pole assembly 18 could be of circular cross-section instead of square. However, it is believed that a square cross-section provides the greatest strength and stability. The poles 62, 76, 82 of the pole assembly 18 could also be made out of a number of materials, such as metals or plastics, as could all the parts of the banner stand. The preferred embodiment of the present invention includes the hanger pin 64 being inserted into the pin bore 100. However, any releasable connector would be sufficient for attaching the hanger 20 to the pole assembly 18. As people who utilize banners and banner stands for presentations and trade shows often travel, making these out of principally non-metallic parts would have the benefit of not setting off metal detectors at airports.

There are many benefits to the banner stand 10 of the present invention. The construction of the base tube 22 and the feet 16 provide excellent stability. The feet 16 are riveted to and rest against the flat portion P of the base tube 22. As moments applied to the banner stand will serve to deform and loosen the rivets, the construction and design of the tube and feet provide excellent stability as a greater moment must be applied to loosen the rivets. The banner stand 10 also incorporates two of such feet 16 which create a greater area of stability and provide stability closer to the ends of the base tube 22.

Another benefit of the banner stand 10 is that the banner is held in tension. It is preferred that, in order to attach the hanger 20 to the hanger pin 64, the spring 72 of the pole assembly 18 should be slightly compressed so that it places the banner 12 in tension. The preferred spring 72 is approximately 1" in length with the maximum compression approximately 0.5", which is greater than is necessary for attaching the banner 12. The tension on the banner 12 provides a smooth banner 12 and presents an attractive, orderly image and presentation.

A further benefit is the ease with which the banner stand 10 and banner 12 may be stored. The storage compartment 23 inside the base tube 22 allows the pole assembly 18 to be stored without protruding. The end cap 28 is connected so as to not be separated from the base tube 22 while being suitably attractive for the banner stand 10. Because the banner 12 itself rolls around the base tube 22 when being stored, the banner 12 does not have friction across its face F which could wear or diminish the attractiveness of the banner 12, a problem some banner stands do encounter.

A further benefit is the elastic cord 90. The elastic cord 90 holds the pole assembly 18 together when it is assembled and erected. The elastic cord 90 requires a force to be stretched. Accordingly, the pole assembly 18 requires no further tightening of screws or other fasteners in order to erect. In addition, the pole assembly 18 has no loose parts so that when it is collapsed it remains together and can be easily stored within the base tube 22.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense. Merely by way of example, the pole assembly may be made in a different number of sections, of different materials, and of different cross section. A four-section fiberglass round tube is now particularly preferred. Other variations, within the scope of the appended claims, will occur to those skilled in the art.

What is claimed is:

1. A banner stand for displaying a banner comprising:

a generally tubular base;

a banner wrapped around the base; and a pole assembly contained inside the base.

2. The banner stand of claim 1 wherein the banner is attached to an external surface of the base.

3. The banner stand of claim 1 wherein the pole assembly includes a spring, said spring being compressed in order to attach the banner to the pole assembly so that the banner is under tension.

4. The banner stand of claim 1 further comprising a hanger attached to the banner.

5. The banner stand of claim 1 further including a carrying case, the banner stand being removably contained in the carrying case.

6. A banner stand for displaying a banner comprising:

a banner;

a base tube with the banner attached;

a hanger attached to the banner; and a collapsible pole assembly including a spring, said spring being compressed in order to attach the banner to the pole assembly so the banner is under tension, wherein said base tube is generally hollow and said Dole assembly is stored within the base tube.

7. The banner stand of claim 6 wherein the banner may be wrapped around an external surface of the base tube.

8. The banner stand of claim 6 wherein said spring is located within said pole assembly.

9. The banner stand of claim 6 wherein said pole assembly further comprises an elastic cord.

10. The banner stand of claim 9, wherein a center of said pole assembly is generally hollow, and wherein said elastic cord is located within said center of said pole assembly.

11. The banner stand of claim 6 wherein said pole assembly comprises a first pole, a second pole, and a third pole.

12. The banner stand of claim 6 further including a carrying case, the banner stand being removably contained in the carrying case.

13. The banner stand of claim 6 wherein said pole assembly has a square cross-section.

14. A banner stand for displaying a banner comprising:

a banner;

a pole assembly;

a hanger attached to the banner and to the pole assembly;

a base including a generally horizontal hollow base tube, said base tube including a socket for mounting said Pole assembly in a vertical position wherein said socket includes a spacer and a pole bore, said pole assembly fitting into said pole bore and said spacer fitting within the pole assembly so as to secure said pole assembly in a vertical position.

15. The banner stand of claim 14 wherein said base further includes at least one elongate flat foot, wherein said base tube includes a lower external flat surface, wherein said foot each has a point of mounting against said external flat surface of the base tube and may be rotated around respective points of mounting to be orthogonal to the central axis of the base tube when the banner stand is erected and to be parallel to central axis of the base tube when the banner stand is collapsed and stored.

16. The banner stand of claim 14 wherein said spacer is mounted by a pole rivet located on an inside surface of said base tube, and wherein said spacer is located diametrically opposite said pole bore.

17. A banner stand for displaying a banner comprising:

a banner;

a pole assembly;

a hanger attached to the banner and to the pole assembly;

a base including a generally horizontal hollow base tube, said base tube including a socket for mounting said pole assembly in a vertical position, wherein said pole assembly may be collapsed such that the pole assembly may be inserted into one end of and completely enclosed within the base tube during storage.

18. The banner stand of claim 17 wherein said base tube includes end caps for securing said pole assembly within said base tube during storage.

19. A method of collapsing a banner stand with an attached banner, the method comprising the steps of:

compressing a spring located within a pole assembly to release tension on a sign or banner;

disconnecting the pole assembly from a hanger to which the banner is attached;

collapsing the pole assembly;

storing the pole assembly on or in a base tube to which the banner is attached;

rotating at least one foot attached to said base tube so that the foot is substantially parallel to the central axis of the base tube; and rolling the banner around the base tube.

20. The method of claim 19 wherein the step of collapsing the pole assembly includes:

disconnecting multiple poles which remain connected by an elastic cord;

removing the bottom end of the pole assembly from the base tube; and aligning the multiple poles against each other so they may be stored side-by-side within the base tube.

21. The method of claim 20 wherein the closure is a Velcro strip and its mate.

22. The method of claim 19 wherein the steps of the method further include:

securing the pole assembly within the base tube by closing the ends of the base tube with end caps; and securing the end caps with closures.

23. The method of claim 22 wherein the closures are Velcro strips and their mates.

24. The method of claim 19 wherein the steps of the method further include:

securing the banner after it has been rolled around the base tube with a closure.

* * * * *

UNITED STATES PATENT AND TRADEMARK OFFICE

CERTIFICATE OF CORRECTION

PATENT NO. : 6,643,966 B2
DATED : November 11, 2003
INVENTOR(S) : Anthony J. Schmitt It is certified that error appears in the above-identified patent and that said Letters Patent is hereby corrected as shown below:

Column 8,
Line 8, replace "Dole" with -- pole --

Signed and Sealed this

Fifteenth Day of June, 2004

JON W. DUDAS
*Acting Director of the United States Patent and Trademark Office*